United States Patent [19]

Wozniacki

[11] 4,361,267

[45] Nov. 30, 1982

[54] FOUR-CORNER DESIGN FOR OCTAGONAL CONTAINER

[75] Inventor: Roger M. Wozniacki, 3218 Flaming Candle, Spring, Tex. 77373

[73] Assignee: Roger M. Wozniacki, Spring, Tex.

[21] Appl. No.: 233,537

[22] Filed: Feb. 11, 1981

[51] Int. Cl.[3] ..... B65D 5/10

[52] U.S. Cl. ..... 229/39 R; 229/41 C

[58] Field of Search ..... 229/41 C, 41 D, 38, 229/16 R, 39 R, 37 R

[56] References Cited

U.S. PATENT DOCUMENTS

| | | | |
|---|---|---|---|
| 1,425,549 | 8/1922 | Scruby | 206/8 |
| 1,909,649 | 5/1933 | Bayless | 229/37 R |
| 2,471,173 | 5/1949 | Taylor | 229/41 C |
| 2,565,188 | 8/1951 | Welshenlach | 229/16 C |
| 2,674,400 | 4/1954 | Ross | 229/37 R |
| 2,762,552 | 9/1956 | Hickin | 229/38 |
| 2,844,296 | 7/1958 | Soja | 229/39 R |
| 3,174,675 | 3/1965 | Rosenburg, Jr. | 229/41 C |
| 3,302,853 | 2/1967 | Locke | 229/39 R |
| 3,487,990 | 1/1970 | Overton et al. | 229/23 R |
| 3,526,352 | 9/1970 | Swett | 229/39 R |
| 3,873,017 | 3/1975 | Blatt | 229/41 C |
| 3,907,194 | 9/1975 | Davenport et al. | 222/121 |
| 4,101,022 | 7/1978 | Watkins | 206/45.14 |
| 4,114,795 | 9/1978 | Mulroy | 229/39 R |
| 4,119,266 | 10/1978 | Dempster | 229/41 C X |
| 4,225,078 | 9/1980 | Croley | 229/41 C |

*Primary Examiner*—Joseph Man-Fu Moy
*Assistant Examiner*—Gary E. Elkins
*Attorney, Agent, or Firm*—Penelope A. Smith

[57] ABSTRACT

An octagonal container having a unique bottom closure and a blank therefor are provided. The body of the octagonal container includes a pair of major wall panels, a pair of minor wall panels, and four corner wall panels. Each major and minor wall panel is foldably connected to a corner wall panel on either side. In the preferred embodiment, one of the minor wall panels is formed from two pieces, which are secured in overlapping relation to one another. The closure section includes a pair of rectangular major cover flaps, a pair of rectangular minor cover flaps, and four polygonal corner flaps. Each major cover flap is foldably connected to a major wall panel. Each corner flap is foldably connected to a corner wall panel. Each minor cover flap is foldably connected to a minor wall panel. In the preferred embodiment, one of the minor cover flaps is formed from two pieces, which are fastened in overlapping relation to one another. In the preferred embodiment, each corner flap features a diagonal score line which divides the flap into an extension arm and an engagement flap, and each major cover flap features a pair of vertical slots aligned in parallel. The closure is formed by first folding the minor cover flaps inward at right angles to the minor wall panels and then folding the major cover flaps inward at right angles to the major wall panels to overlie the minor cover flaps. Finally, the corner flaps are folded inward and secured in overlapping relation to the major cover flaps. In the preferred embodiment, the corner flaps are creased along their diagonal score lines so that each engagement flap extends inward at an angle to the attached reinforcing arm. Then, the engagement flap is inserted into the corresponding slot in a major cover flap and either straightened, or bent backward on the diagonal score line to form a secure, flat-bottomed closure.

13 Claims, 5 Drawing Figures

FOUR-CORNER DESIGN FOR OCTAGONAL CONTAINER

BACKGROUND OF THE INVENTION

This invention relates to octagonal paperboard containers, and more particularly to a closure construction for such containers.

Octagonal containers made from the heavier grades of paperboard are widely used for transporting heavy items in bulk quantities. In the meat-packaging industry, for example, open-topped octagonal bins are used to transport palletized loads of meat through the packing plant. Such bins must be suitable for rapid manual assembly by plant workmen. However, the assembled bins must also be sturdy enough to carry heavy loads without tearing and to withstand stress during transportation and handling. The configuration of the bottom closure is critical in insuring that the bin meets these requirements.

DETAILED DESCRIPTION OF THE INVENTION

Figure 1:
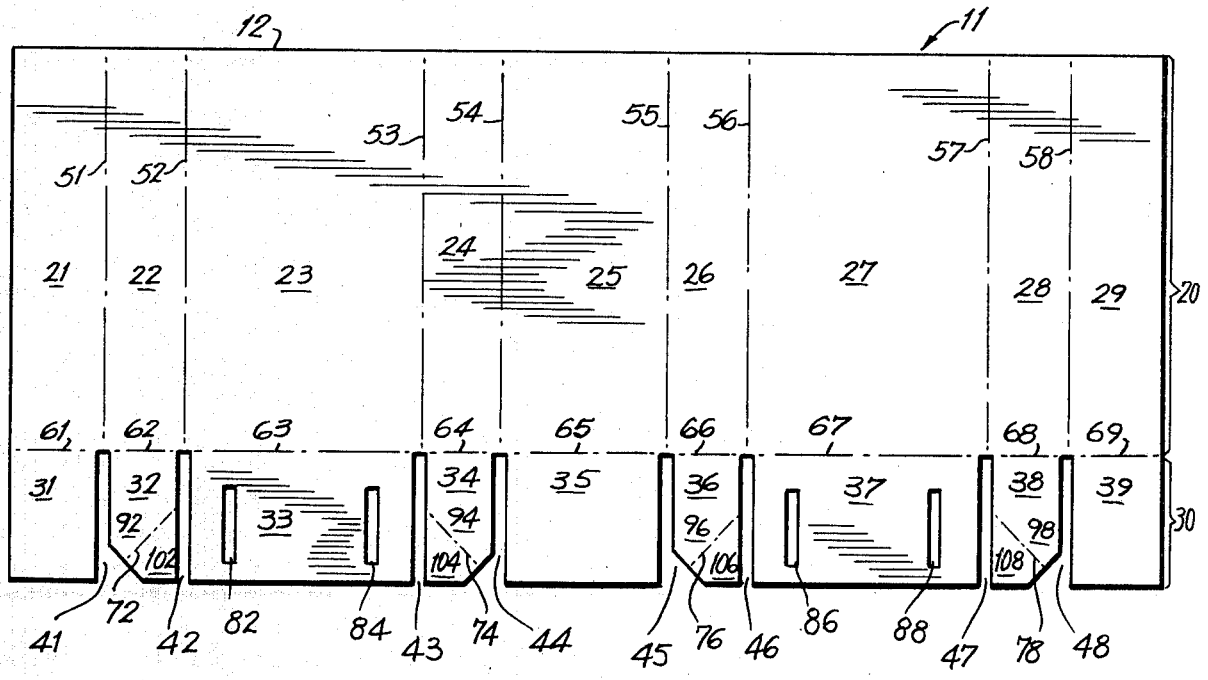
FIG. 1 is a plan view of a blank from which a bin embodying the present invention may be constructed.
Figure 2:
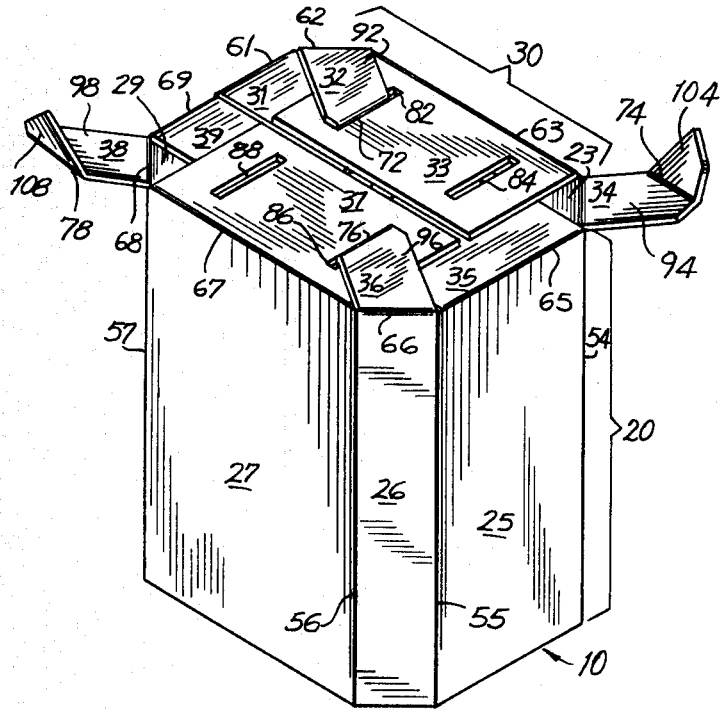
FIG. 2 is a perspective view of a partially assembled bin constructed from the blank of FIG. 1, the bin being shown in an inverted position to more clearly illustrate the bottom closure.
Figure 3:
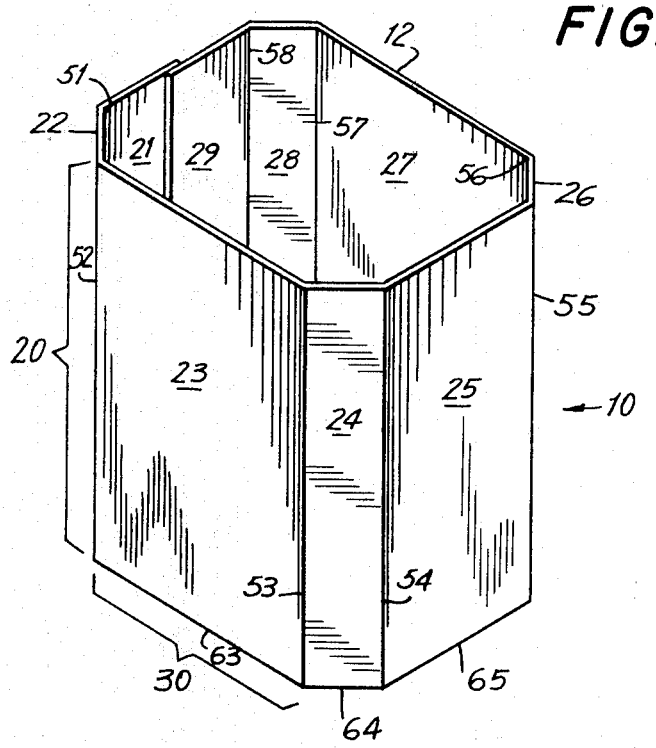
FIG. 3 is a perspective view of a fully assembled bin constructed from the blank of FIG. 1, the bin being shown in an upright position.
Figure 4:
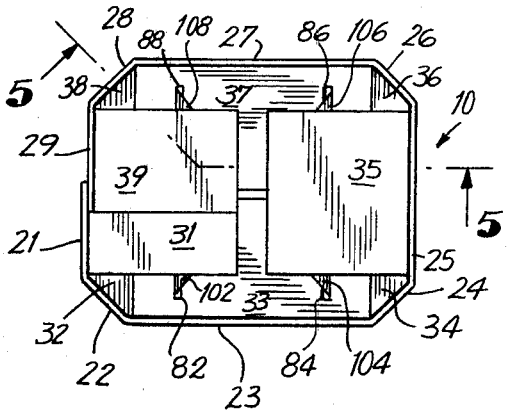
FIG. 4 is a top plan view of the bin of FIG. 5, showing the interior of the bin.
Figure 5:
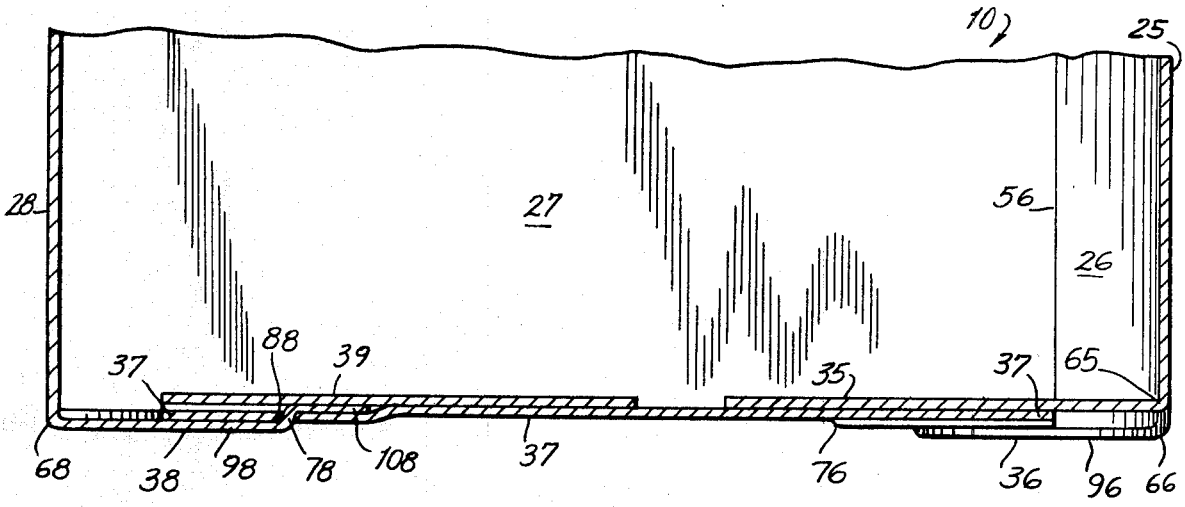
FIG. 5 is a cutaway view of the bottom closure of the bin, taken along line 5—5 of FIG. 4.

Referring now to the drawings, and in particular to FIG. 1, a blank for a bin constructed in accordance with one embodiment of the present invention is indicated generally at 11. The blank, 11, includes a body section, indicated generally at 20 and bounded at the top by edge 12, and a closure section, indicated generally at 30. For purposes of illustration, FIG. 2 shows the bin, 10, assembled from blank 11 in an inverted position to more clearly illustrate the construction of the bottom closure. FIGS. 3–5 show the bin in its upright position.

The blank, 11, is formed from a single sheet of foldable paperboard. The blank is preferably formed from corrugated board; single-wall or multi-wall board of various weights, with or without a water-resistant finish, may be chosen depending on the characteristics required of the finished container. The unfolded blank is generally rectangular in shape, to minimize board waste in manufacturing the blanks, and to facilitate stacking, shipping and storage of unassembled blanks.

The body section, 20, of blank, 11, comprises a substantially rectangular first partial minor wall panel, 21, a pair of substantially rectangular major wall panels, 23 and 27, a substantially rectangular complete minor wall panel, 25, four substantially rectangular corner wall panels, 22, 24, 26 and 28, and a substantially rectangular second partial minor wall panel, 29. The major and minor wall panels are foldably connected in alternating series by the corner wall panels. In the illustrated embodiment, the series begins and ends with a partial minor wall panel. In another embodiment, however, the series begins and ends with a partial major wall panel; the body section comprises a pair of minor wall panels, one complete major wall panel, four corner wall panels, and first and second partial major wall panels. A blank having a second complete minor wall panel and a manufacturer's panel instead of first and second partial minor wall panels is also within the scope of the invention. In this last alternative embodiment, the series may begin with a corner wall panel instead of a major wall panel or a minor wall panel, and the manufacturer's panel may be attached at either the beginning or the end of the series.

Referring again to FIG. 1, first partial minor wall panel 21 is foldably connected to corner wall panel 22 along vertical score line 51. Major wall panel 23 is foldably connected to corner wall panels 22 and 24 along vertical score lines 52 and 53 respectively. Complete wall panel 25 is foldably connected to corner wall panel 24 along vertical score line 54 and to corner wall panel 26 along vertical score line 55. Major wall panel 27 is foldably connected to corner wall panels 26 and 28 along vertical score lines 56 and 57 respectively. Corner wall panel 28 is foldably connected to second partial minor wall panel 29 along vertical score line 58.

The bottom closure section, 30, of blank, 11, comprises a first partial minor cover flap, 31, a pair of major cover flaps, 33 and 37, a complete minor cover flap, 35, four corner flaps, 32, 34, 36, and 38 and a second partial minor cover flap, 39. First partial minor cover flap 31 is foldably connected to first partial minor wall panel 21 along horizontal score line 61. Corner flap 32 is foldably connected to corner wall panel 22 along horizontal score line 62. Major cover flap 33 is foldably connected to major wall panel 23 along horizontal score line 63. Corner flap 34 is foldably connected to corner wall panel 24 along horizontal score line 64. Complete minor cover flap 35 is foldably connected to complete minor wall panel 25 along horizontal score line 65. Corner flap 36 is foldably connected to corner wall panel 26 along horizontal score line 66. Major cover flap 37 is foldably connected to major wall panel 27 along horizontal score line 67. Corner flap 38 is foldably connected to corner wall panel 28 along horizontal score line 68. Second partial minor cover flap 39 is foldably connected to second partial minor side panel 29 along horizontal score line 69.

In the preferred embodiment which is illustrated in the drawings, minor and major cover flaps are substantially rectangular and the combined heights of major cover flap 33 and major cover flap 37 are equal to the width of one of the minor wall panels, so that the assembled closure forms a substantially complete floor for the container. Major cover flap, 33, features a pair of vertical slots 82 and 84 placed at a predetermined distance from the edges of the flap 33. Major cover flap, 37, features a pair of vertical slots, 86 and 88, placed at a predetermined distance from the edges of flap 37. Two of the corner flaps are left polygonal corner flaps and two are right polygonal corner flaps. Each of the left polygonal corner flaps 32 and 36 features a left diagonal score line extending upwardly across the panel in a left-to-right direction to a predetermined point on the right edge of the corner flap. Each of the right polygonal corner flaps, 34 and 38, features a right diagonal score line extending upwardly across the panel in a right to left direction to a predetermined point on the left edge of the corner flap. It will be obvious from the drawings that the location of these points is fixed by the distance between the slots and the edges of the major cover flaps. The diagonal score lines divide the polygonal corner flaps into extension arms, which are adjacent to and foldably connected with the corner wall panels, and engagement flaps. Thus, left polygonal corner flap, 32, is divided by diagonal score line 72 into extension arm 92 and engagement flap 102. Right polygonal corner flap 34 is divided by diagonal score line 74 into extension arm 94 and engagement flap 104. Left polygonal corner flap 36 is divided by diagonal score line 76 into extension arm 96 and engagement flap 106. Right polygonal corner flap 38 is divided by diagonal score line 78 into extension arm 98 and engagement flap 108.

In the closure section, adjacent flaps are not connected, but are separated by slit lines, or, preferably, notches. Notches are preferred since they facilitate the assembly of the container; the width of the notches should be determined as a function of the weight and thickness of the board. Thus, for example, it is preferred that the width of the notches be about $\frac{3}{8}''$ when #450 BIC board is used. In the illustrated embodiment, each polygonal corner flap is truncated on the side adjacent to a minor cover flap. Thus the lower left corners of left polygonal corner flaps 32 and 36 are truncated, so that notches 41 and 45 resemble stylized "h'"s. Similarly, the lower right corners of right polygonal corner flaps 34 and 38 are truncated so that notches 44 and 48 resemble reversed stylized "h'"s. The notches, 42, 43, 46, and 47, each located between a corner flap and a major cover flap, are preferably straight cuts. It is preferred that narrow cuts rather than slits be formed to facilitate folding of the blank. The preferred width of notches 42, 43, 46, and 47, and of the straight upper portions of notches, 41, 44, 45, and 48 will depend on the grade of the board used to form the blank. The width of slots 82, 84, 86, and 88 is preferably about equal to the width of the notches.

Referring now to FIGS. 2–5, blank 11 is assembled to form bin 10 by first folding blank 11 along vertical score line 51, 52, 53, 54, 55, 56, 57, and 58 to form an octagonal tube. First partial minor wall panel 21 and first partial minor cover flap 31 are secured in overlapping relation to second partial minor wall panel 29 and second partial minor cover flap 39 respectively by some suitable securing means, such as adhesive, tape, or staples. The partially assembled bin may then be inverted, as shown in FIG. 2, to facilitate the assembly of the bottom closure.

The first step in assembling the bottom closure of the present invention is folding complete minor cover flap 35 inward at right angles to complete minor wall panel 25 and folding the minor cover flap formed by first partial minor cover flap 31 and second partial minor cover flap 39 inward at right angles to the minor wall panel formed by first partial minor wall panel 21 and second partial minor wall panel 29. Next, major cover flap 33 is folded inward at right angles to major wall panel 23 and major cover flap 37 is folded inward at right angles to major wall panel 27. As shown in FIGS. 2 and 4, major cover flap 33 externally overlaps first partial minor cover flap 31 and complete minor cover flap 35 while major cover flap 37 externally overlaps second partial minor cover flap 39 and complete minor cover flap 35. Finally, the corner flaps are folded inward and secured in externally overlapping relation to the major cover flaps. In the preferred embodiment, this is accomplished by inserting the engagement flaps through the slots in the major cover flaps. Thus, engagement flap 102 is folded inward along diagonal score line 72, engagement flap 104 is folded inward along diagonal score line 74, engagement flap 106 is folded inward along diagonal score line 76 and engagement flap 108 is folded inward along diagonal score line 78. In FIG. 4, right polygonal corner flaps 34 and 38 are shown folded outward along horizontal scorelines 64 and 68 respectively to better illustrate this step in the folding sequence. Then, left polygonal corner flap 32 is folded inward along horizontal score line 62 and engagement flap 102 is inserted into slot 82 in major cover flap 33. Right polygonal corner flap 34 is folded inward along horizontal score line 64 and engagement flap 104 is inserted into slot 84 in major cover flap 33. Left polygonal corner flap 36 is folded inward along horizontal score line 66 and engagement flap 106 is inserted into slot 86 in major cover flap 37. Right polygonal corner flap 38 is folded inward along horizontal score line 68 and engagement flap 108 is inserted into slot 88 in major cover flap 37. As shown in FIGS. 2 and 4, extension arm 92 externally overlaps first partial minor cover flap 31 and major cover flap 33, and extension arm 96 externally overlaps complete minor cover flap 35 and major cover flap 37. As FIG. 4 illustrates, extension arm 94 externally overlaps complete minor cover flap 35 and major cover flap 33, and extension arm 98 externally overlaps second partial minor cover flap 39 and major cover flap 37. The major cover flaps, minor cover flaps, and corner flaps together form a substantially complete floor for the bin. In the assembled closure, each of the engagement flaps is caught between a major cover flap on the outside and a minor cover flap on the inside. The cutaway view of FIG. 5, for example, shows that engagement flap 108 lies between major cover flap 37 and second partial minor cover flap 39. The completed bin is then upended, as shown in FIG. 3, for loading. Since the closure panels form a substantially complete floor for the bin a separate floor pad is not required. The overlapping arrangement of the flaps promotes even stress distribution. Furthermore, in the preferred embodiment, the weight of the bin contents tends to fix the engagement flaps in place between the major cover flaps and the minor cover flaps so that the closure tends to remain intact despite overloading and mishandling.

While the octagonal container illustrated in the drawings is an open-ended bin, it is obvious that a covered octagonal container with my novel bottom closure is also within the scope of my invention. For certain applications, it might be desireable to use my closure as the top closure instead of, or in addition to its use as the bottom closure for the container. In adapting this invention to various uses and conditions, many modifications will be obvious to those skilled in the art. In view of this, the following claims are intended to cover all modifications and variations which fall within the true scope and spirit of the invention.

What is claimed is:

1. An octagonal container comprising a body section and a closure section;

the body section comprising a pair of major wall panels, a pair of minor wall panels, and four corner wall panels, the major and minor wall panels being foldably connected in alternating series by the corner wall panels;

the closure section comprising a pair of major cover flaps, a pair of minor cover flaps, and four corner flaps;

each of the major cover flaps comprising a pair of vertical slots, and the four corner flaps comprising a pair of right polygonal corner flaps and a pair of left polygonal corner flaps, each of the right polygonal corner flaps being divided by a right diagonal score line into an extension arm and an engagement flap, each of the left polygonal corner flaps being divided by a left diagonal score line into an extension arm and an engagement flap, each of the minor cover flaps being foldably connected to and folded inward at right angles to a minor wall panel, each of the major cover flaps being foldably connected to and folded inward at right angles to a major wall panel in externally overlapping relation to the minor cover flap, each of the corner flaps being foldably connected to and folded inward at right angles to a corner wall panel, and each of the corner flaps being secured in externally overlapping relation to the adjacent major cover flap by inserting the engagement flap into one of the vertical slots.

2. A container according to claim 1 wherein each of the major and minor cover flaps is substantially rectangular in shape, and wherein the combined heights of the major cover flaps are substantially equal to the width of a minor wall panel, whereby the closure forms a substantially complete floor for the container.

3. A container according to claim 2 wherein one of the minor panels comprises a complete minor wall panel and the other minor wall panel comprises a first partial minor wall panel and a second partial minor wall panel, the first partial minor wall panel being secured in overlapping relation to the second partial minor wall panel.

4. A container according to claims 1 or 3 wherein each corner flap is truncated on the side adjacent to a minor cover flap.

5. A paperboard blank for an octagonal container comprising a body section and a closure section;

the body section comprising a first partial minor wall panel, a pair of major wall panels, a complete minor wall panel, four corner wall panels, and a second partial minor wall panel, the minor and major wall panels being foldably connected in series by the corner wall panels;

the closure section comprising a first partial minor cover flap foldably connected to the first partial minor wall panel, a pair of major cover flaps, each major cover flap being foldably connected to a major wall panel, each of the major cover flaps comprising a pair of vertical slots, a complete minor cover flap foldably connected to the complete minor wall panel, four corner flaps, each corner flap being foldably connected to a corner wall panel, the four corner flaps comprising a pair of right polygonal corner flaps and a pair of left polygonal corner flaps, each of the right polygonal corner flaps being divided by a right diagonal score line into an extension arm and an engagement flap, and each of the left polygonal corner flaps being divided by a left diagonal score line into an extension arm and a engagement flap and a second partial minor cover flap foldably connected to the second partial minor wall panel.

6. A blank according to claim 5 wherein each of the major and minor cover flaps is substantially rectangular in shape, and wherein the combined heights of the major cover flaps are substantially equal to the width of a minor wall panel.

7. A blank according to claim 6 wherein each corner flap is truncated on the side adjacent to a minor cover flap.

8. A paperboard blank for an octagonal container comprising a body section and a closure section;

the body section comprising a pair of minor wall panels, a pair of major wall panels, four corner wall panels and a manufacturer's panel, the minor and major wall panels being foldably connected in series by the corner wall panels, and manufacturer's panel being foldably connected to one end of the series;

the closure section comprising a pair of minor cover flaps, each minor cover flap being foldable connected to a minor wall panel, a pair of major cover flaps, each major cover flap being foldably connected to a major wall panel, and four corner flaps, each corner flap being foldably connected to a corner wall panel, each of the major cover flaps comprising a pair of vertical slots, and the four corner flaps comprising a pair of right polygonal corner flaps and a pair of left polygonal corner flaps, each of the right polygonal corner flaps being divided by a right diagonal score line into an extension arm and an engagement flap, and each of the left polygonal corner flaps being divided by a left diagonal score line into an extension arm and engagement flap.

9. A blank according to claim 8 wherein each of the major and minor cover flaps is substantially rectangular in shape, and wherein the combined heights of the major cover flaps are substantially equal to the width of a minor wall panel.

10. A blank according to claim 9 wherein each corner flap is truncated on the side adjacent to a minor cover flap.

11. A paperboard blank for an octagonal container comprising a body section and a closure section;

the body section comprising a first partial major wall panel, a pair of minor wall panels, and complete major wall panel, four corner wall panels, and a second partial major wall panel, the minor and major wall panels being foldably connected in series by the corner wall panels;

the closure section comprising a first partial major cover flap;

foldably connected to the first partial major wall panel, a pair of minor cover flaps, each minor cover flap being foldably connected to a minor wall panel, a complete major cover flap foldably connected to the complete major wall panel, four corner flaps each corner flap foldably connected to a corner wall panel, and a second partial major cover flap foldably connected to the second partial major wall panel, the complete major cover flap comprising a pair of vertical slots, each of the partial major cover flaps comprising one vertical slot, and the four corner flaps comprising a pair of right polygonal corner flaps and a pair of left polygonal corner flaps, each of the right polygonal corner flaps being divided by a right diagonal score line into an extension arm and an engagement flap, and each of the left polygonal corner flaps being divided by a left diagonal score line into an extension arm and an engagement flap.

12. A blank according to claim 11 wherein each of the major and minor cover flaps is substantially rectangular in shape, and wherein the combined heights of the major cover flaps are substantially equal to the width of a minor wall panel.

13. A blank according to claim 12 wherein each corner flap is truncated on the side adjacent to a minor cover flap.

* * * * *

UNITED STATES PATENT AND TRADEMARK OFFICE

CERTIFICATE OF CORRECTION

PATENT NO. : 4,361,267

DATED : 11/30/82

INVENTOR(S) : Roger M. Wozniacki

It is certified that error appears in the above-identified patent and that said Letters Patent are hereby corrected as shown below:

In the heading, item (73) Assignee:, delete "Roger M. Wozniacki, Spring, Texas" and insert -- International Paper Company, New York, N.Y. --.

Signed and Sealed this

*Fifteenth* Day of *March 1983*

[SEAL]

*Attest:*

GERALD J. MOSSINGHOFF

*Attesting Officer*

*Commissioner of Patents and Trademarks*